US009356404B2

(12) United States Patent
Yu et al.

(10) Patent No.: US 9,356,404 B2
(45) Date of Patent: May 31, 2016

(54) ELECTRICAL CONNECTOR

(71) Applicant: HON HAI PRECISION INDUSTRY CO., LTD., New Taipei (TW)

(72) Inventors: Chun-Ming Yu, Kunshan (CN); Ce Jiang, Kunshan (CN); Guo-Hua Zhang, Kunshan (CN); Qi-Sheng Zheng, Kunshan (CN); Bin Guo, Kunshan (CN)

(73) Assignee: HON HAI PRECISION INDUSTRY CO., LTD., New Taipei (TW)

( * ) Notice: Subject to any disclaimer, the term of this patent is extended or adjusted under 35 U.S.C. 154(b) by 0 days.

(21) Appl. No.: 14/495,846

(22) Filed: Sep. 24, 2014

(65) Prior Publication Data

US 2015/0087172 A1 Mar. 26, 2015

(30) Foreign Application Priority Data

Sep. 25, 2013 (CN) ..... 2013 1 0438501
Sep. 25, 2013 (CN) ..... 2013 1 0439107

(51) Int. Cl.

| | |
|---|---|
| ***H01R 13/6594*** | (2011.01) |
| ***H01R 13/6582*** | (2011.01) |
| *H01R 12/72* | (2011.01) |
| *H01R 13/506* | (2006.01) |
| *H01R 13/6597* | (2011.01) |
| *H01R 107/00* | (2006.01) |

(52) U.S. Cl.

CPC ..... *H01R 13/6594* (2013.01); *H01R 13/6582* (2013.01); *H01R 12/724* (2013.01); *H01R 13/506* (2013.01); *H01R 13/6597* (2013.01); *H01R 2107/00* (2013.01)

(58) Field of Classification Search

CPC ..... H01R 13/6597
USPC ..... 439/95
See application file for complete search history.

(56) References Cited

U.S. PATENT DOCUMENTS

| | | | | |
|---|---|---|---|---|
| 4,493,525 | A * | 1/1985 | Hall | H01R 9/032 439/607.47 |
| 5,342,209 | A * | 8/1994 | Carney | H01R 9/2483 439/532 |
| 6,066,000 | A * | 5/2000 | Masumoto | H01R 13/6593 439/497 |
| 6,067,710 | A * | 5/2000 | Sakaoka | H01R 13/652 29/842 |
| 6,361,365 | B1 * | 3/2002 | Yu | H01R 13/648 439/607.22 |
| 6,540,556 | B1 * | 4/2003 | Fu | H01R 13/6597 439/108 |
| 6,793,508 | B2 * | 9/2004 | Chang | H01R 4/66 439/189 |

(Continued)

FOREIGN PATENT DOCUMENTS

CN 202797485 3/2013

*Primary Examiner* — Ross Gushi
(74) *Attorney, Agent, or Firm* — Wei Te Chung; Ming Chieh Chang

(57) ABSTRACT

An electrical connector includes an insulative housing, a metal shell covering the insulative housing, electrical terminals and auxiliary terminals received in the insulative housing. The electrical terminals includes a number of first contacts. The first contacts include a grounding contact in the middle and some signal contacts on both sides of the grounding contact. The auxiliary terminals includes the retaining portion received in insulative housing and the connecting portion downwardly bent from an end of the retaining portion. The retaining portion has a first spring tab and the connecting has a second spring tab. The first spring tab contacts with the metal shell and the second spring tab contacts with the grounding contact. Such arrangment can improve the anti EMI effect of the electrical connector and reduce the signal interference between the signal terminals.

16 Claims, 10 Drawing Sheets

(56) References Cited

U.S. PATENT DOCUMENTS 7,059,905 B2 * 6/2006 Tanaka ..... H01R 13/65807 439/607.02
7,357,668 B2 * 4/2008 Wan ..... H01R 13/6666 439/541.5
7,410,370 B2 * 8/2008 Sprouse ..... H01R 13/6485 439/95
7,581,967 B2 * 9/2009 Collantes, Jr. ..... H01R 13/6485 439/131
7,682,200 B2 * 3/2010 Zheng ..... H01R 13/6658 439/660
7,686,656 B2 * 3/2010 Zheng ..... H01R 23/6873 439/660
7,717,745 B2 * 5/2010 He ..... H01R 13/642 439/607.23
7,744,382 B2 * 6/2010 Zheng ..... H01R 13/65802 439/577
7,744,426 B2 * 6/2010 Zheng ..... H01R 23/6873 439/660
7,749,000 B1 * 7/2010 Lai ..... H01R 13/64 439/108
7,794,284 B1 * 9/2010 He ..... G02B 6/3817 439/660
7,810,235 B2 * 10/2010 Sprouse ..... H01R 13/6485 29/874
7,837,499 B1 * 11/2010 Chen ..... H01R 12/712 439/541.4
7,841,905 B2 * 11/2010 Zheng ..... H01R 23/6873 439/660
7,972,151 B2 * 7/2011 He ..... H01R 13/65807 439/108
8,430,577 B2 * 4/2013 Sun ..... H01R 12/712 385/88
8,475,218 B2 * 7/2013 Zheng ..... G02B 6/3817 439/660
8,814,443 B2 * 8/2014 He ..... G02B 6/3817 385/49
8,870,597 B2 * 10/2014 Kawakami ..... H01R 13/6471 439/108
8,974,240 B2 * 3/2015 Yu ..... H01R 29/00 439/188
8,986,050 B2 * 3/2015 King ..... H01R 12/7082 439/607.34
2002/0048976 A1 * 4/2002 Zhu ..... H01R 12/725 439/108
2007/0049124 A1 * 3/2007 Chien ..... H01R 13/629 439/668
2009/0023338 A1 * 1/2009 He ..... H01R 43/24 439/607.01
2009/0142946 A1 * 6/2009 Lu ..... H01R 13/6485 439/95
2010/0124829 A1 * 5/2010 He ..... H01R 12/712 439/76.1
2010/0254662 A1 * 10/2010 He ..... H01R 27/00 385/75
2010/0322566 A1 * 12/2010 Zheng ..... G02B 6/32 385/74
2010/0322570 A1 * 12/2010 Zheng ..... G02B 6/32 385/93
2013/0183868 A1 * 7/2013 Hsueh ..... H01R 24/60 439/676
2013/0316568 A1 * 11/2013 Yu ..... H01R 24/60 439/485
2013/0316592 A1 * 11/2013 Yu ..... H01R 13/516 439/660
2013/0330972 A1 * 12/2013 Naito ..... H01R 13/40 439/626
2014/0024263 A1 * 1/2014 Dong ..... H01R 13/516 439/660
2014/0051274 A1 * 2/2014 Yu ..... H01R 13/7031 439/188
2014/0051302 A1 * 2/2014 Yu ..... H01R 13/641 439/660
2014/0051303 A1 * 2/2014 Yu ..... H01R 13/46 439/660
2014/0056587 A1 * 2/2014 Giziewicz ..... G02B 6/3817 398/117
2014/0073169 A1 * 3/2014 Xu ..... H01R 13/11 439/345
2014/0099835 A1 * 4/2014 Chang ..... H01R 13/6581 439/682
2014/0113497 A1 * 4/2014 Wang ..... H01R 13/52 439/660
2014/0134889 A1 * 5/2014 Wu ..... H01R 13/6594 439/676
2014/0245606 A1 * 9/2014 Lin ..... H01R 13/6581 29/884
2014/0364013 A1 * 12/2014 Yu ..... H01R 13/193 439/660
2014/0370729 A1 * 12/2014 Wang ..... H01R 13/6471 439/108
2015/0044899 A1 * 2/2015 Fan ..... H01R 13/50 439/353
2015/0056855 A1 * 2/2015 Yu ..... H01R 13/6594 439/607.01
2015/0087172 A1 * 3/2015 Yu ..... H01R 13/6594 439/108
2015/0147915 A1 * 5/2015 Taniguchi ..... H01R 13/6461 439/660
2015/0200505 A1 * 7/2015 Zeng ..... H01R 24/64 439/676

* cited by examiner

ELECTRICAL CONNECTOR

BACKGROUND OF THE INVENTION

1. Field of the Invention

The present invention relates to an electrical connector, more particularly to an electrical connector with grounding element to reduce electromagnetic interference (EMI).

2. Description of Related Art

China patent issue No. CN202797485U, issued on Mar. 13, 2013, discloses a conventional electrical connector including an insulative housing, a plurality of contacts retained in the insulative housing, and a shell attached to the insulative housing. The shell surrounds the insulative housing to form a mating cavity. The shell has a contact portion extending into the mating cavity forwardly from a top wall thereof The contact portion contacts with a grounding contact. However such arrangement can not well improve the anti-EMI effect of the electrical connector or reduce cross talking between the signal terminals.

Hence, an improved electrical connector with improved structure is needed to solve the problem above.

BRIEF SUMMARY OF THE INVENTION

According to one aspect of the present invention, an electrical connector includes an insulative housing, a metal shell covering the insulative housing, a plurality of electrical terminals and a auxiliary terminal received in the insulative housing. The electrical terminals includes a number of first contacts. The first contacts include a grounding contact in the middle and some signal contacts on both sides of the grounding contact. The auxiliary terminals includes the retaining portion received in insulative housing and the connecting portion downwardly bent from an end of the retaining portion. The retaining portion has a first spring tab and the connecting has a second spring tab. The first spring tab contacts with the metal shell and the second spring tab contacts with the grounding contact.

The foregoing has outlined rather broadly the features and technical advantages of the present invention in order that the detailed description of the invention that follows may be better understood. Additional features and advantages of the invention will be described hereinafter which form the subject of the claims of the invention.

BRIEF DESCRIPTION OF THE DRAWINGS

For a more complete understanding of the present invention, and the advantages thereof, reference is now made to the following descriptions taken in conjunction with the accompanying drawings, in which.

DETAILED DESCRIPTION OF THE PREFERRED EMBODIMENT

In the following description, numerous specific details are set forth to provide a thorough understanding of the present invention. However, it will be obvious to those skilled in the art that the present invention may be practiced without such specific details. In other instances, well-known circuits have been shown in block diagram form in order not to obscure the present invention in unnecessary detail. For the most part, details concerning timing considerations and the like have been omitted inasmuch as such details are not necessary to obtain a complete understanding of the present invention and are within the skills of persons of ordinary skill in the relevant art.

Figure 1:
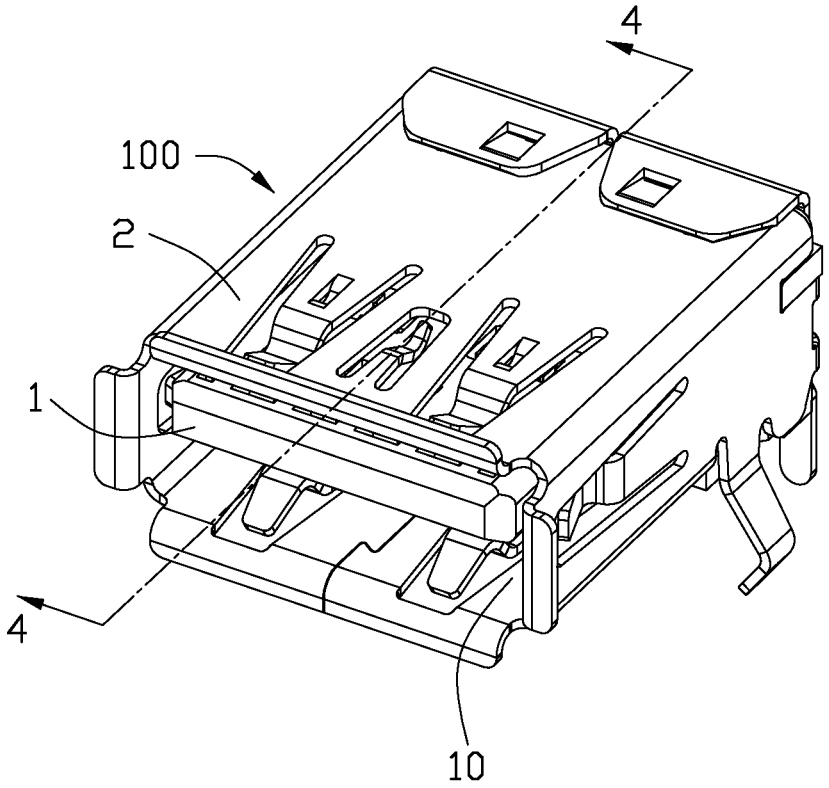
FIG. 1 is a perspective view of an electrical connector in a first embodiment according to the present invention.
Figure 2:
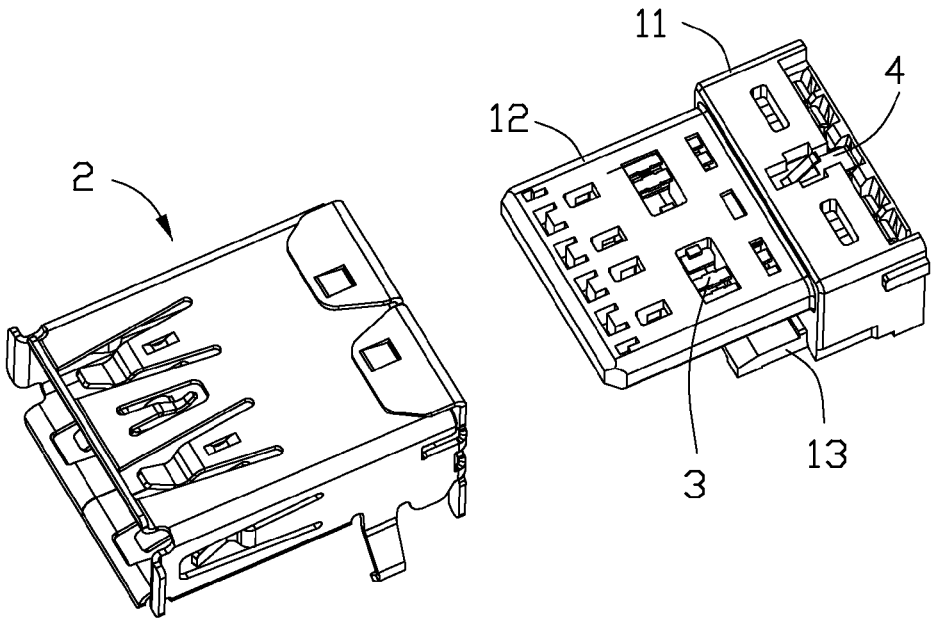
FIG. 2 is a partially exploded, perspective view of the electrical connector.
Figure 3:
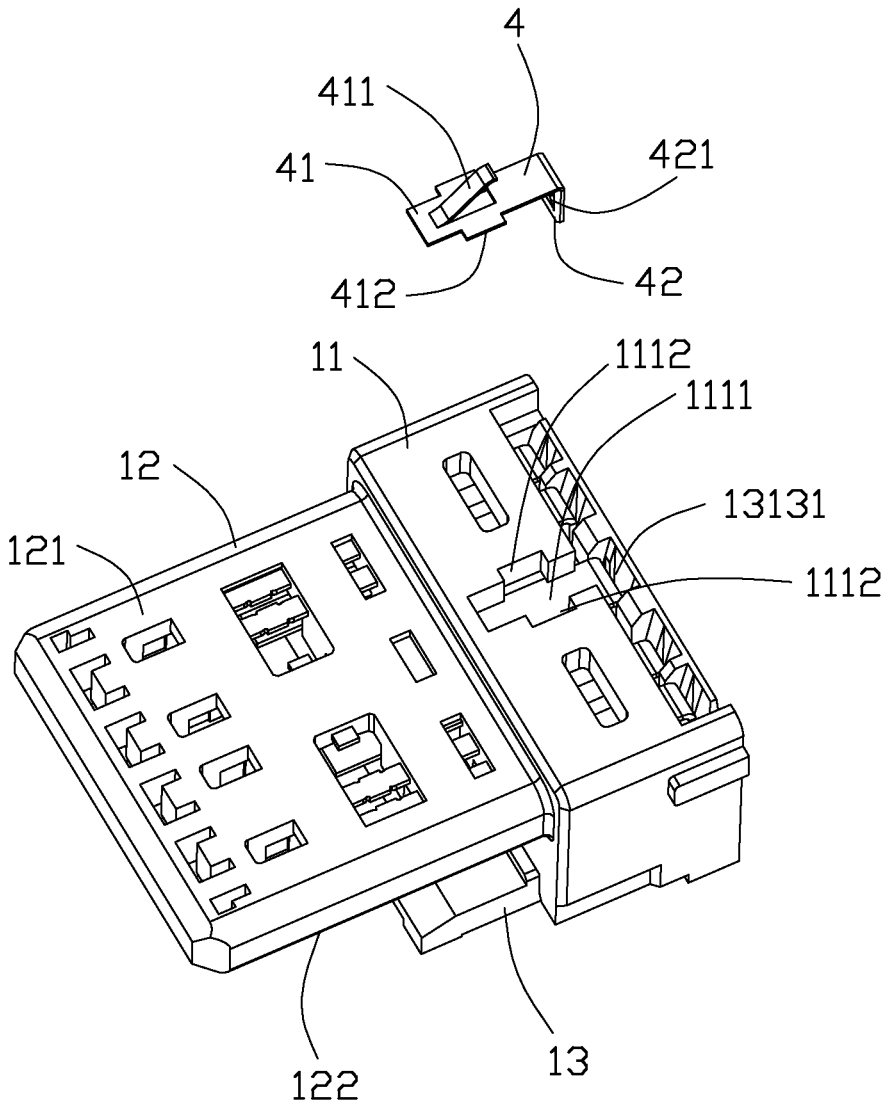
FIG. 3 is another partially exploded, perspective view of the electrical connector without a shell.

Please referring to FIGS. 1-3, an electrical connector 100 includes an insulative housing 1, a plurality of contacts 3 retained in the insulative housing 1, a shell 2 enclosing the insulative housing 1 and a auxiliary contact 4 assembled to the insulative housing 1.

Figure 5:
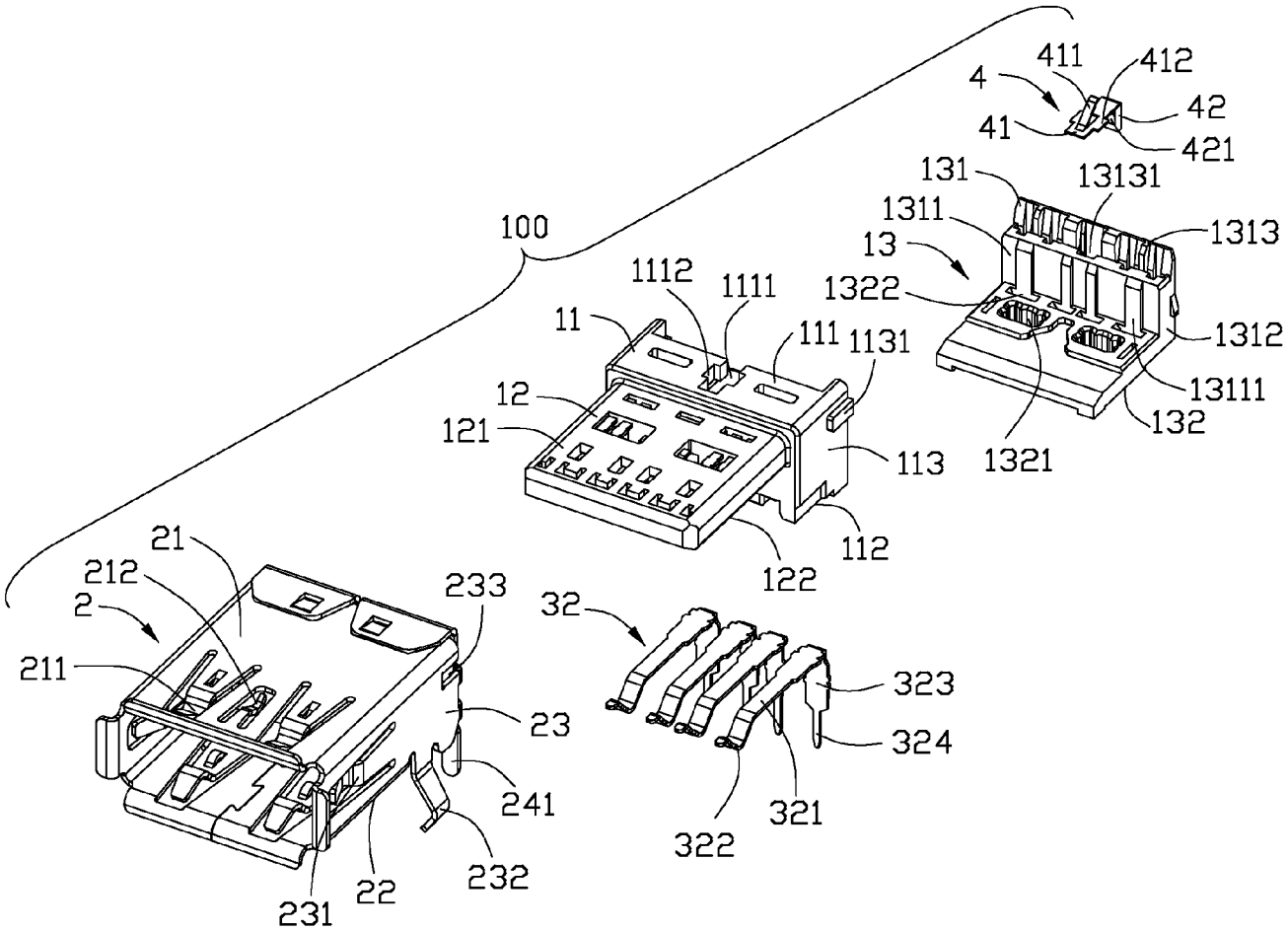
FIG. 5 is a partially exploded, perspective view of the electrical connector.
Figure 6:
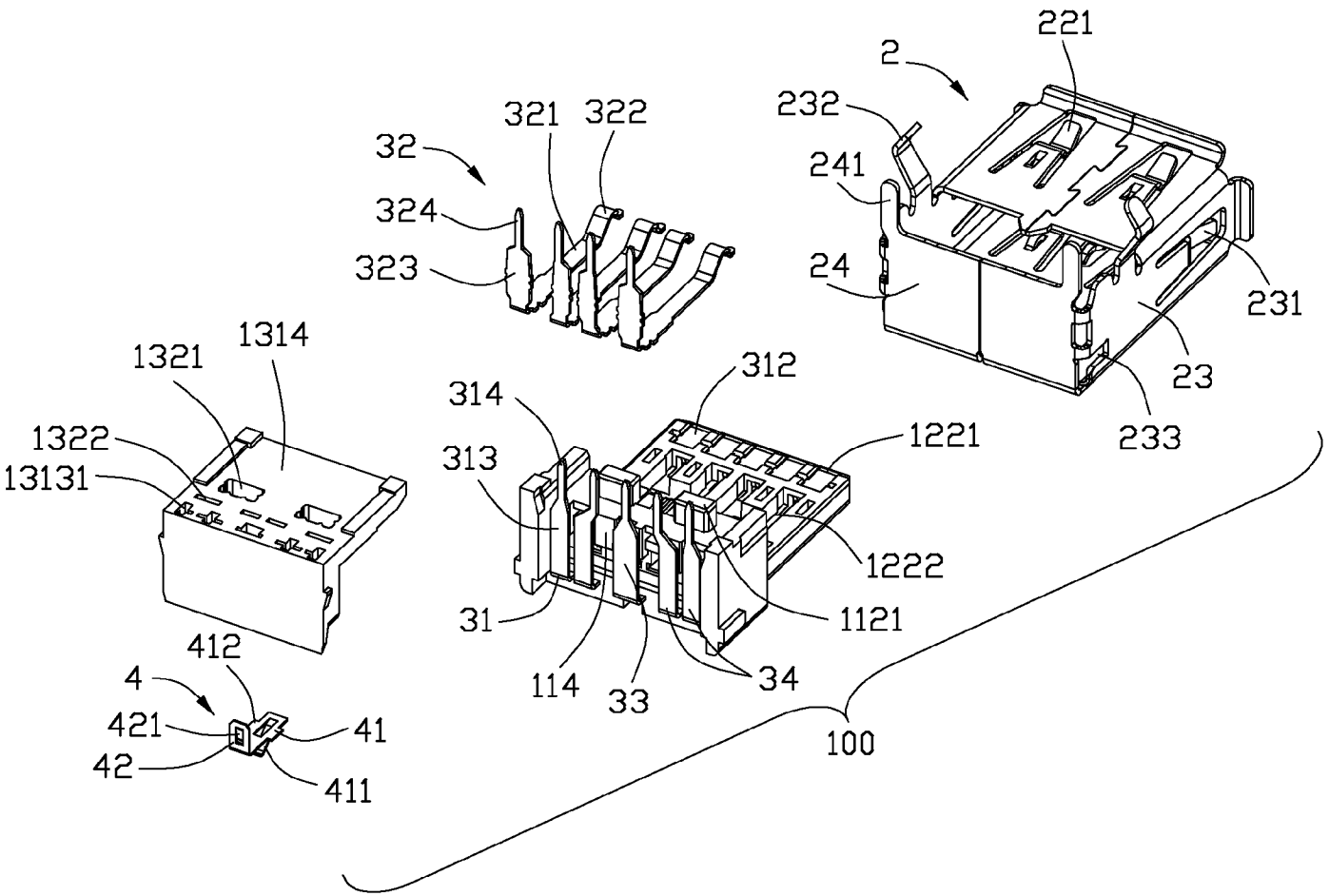
FIG. 6 is a similar view to FIG. 5, but taken from another aspect.
Figure 7:
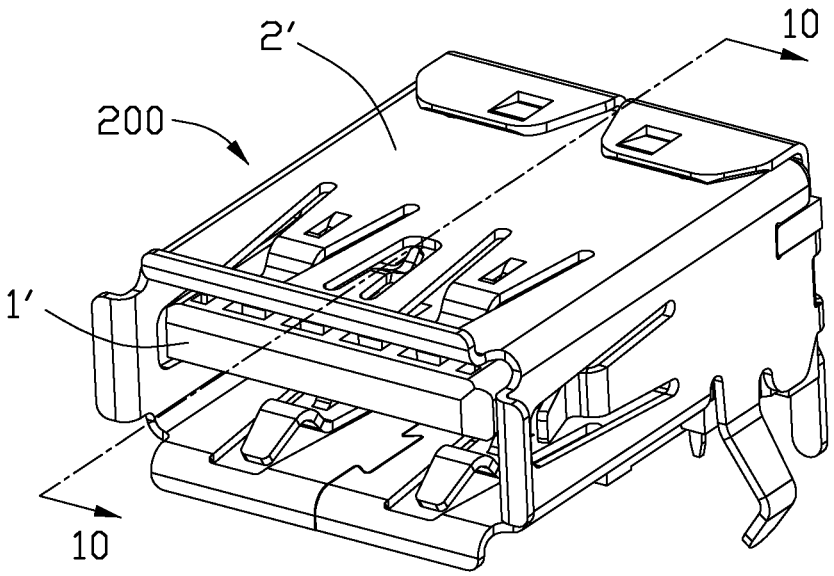
FIG. 7 is an assembled, perspective view of another electrical connector in alternative embodiment according to the present invention.
Figure 8:
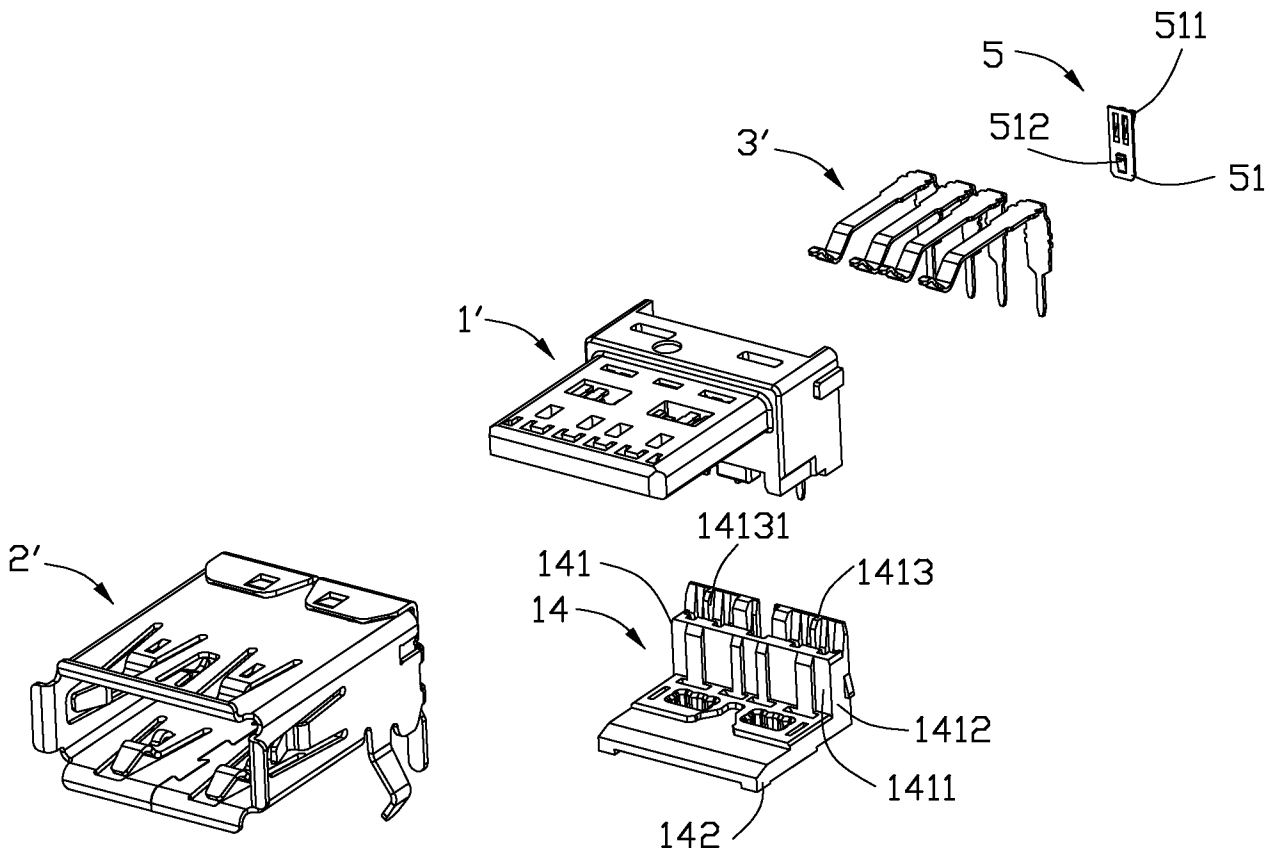
FIG. 8 is a partially exploded, perspective view of the electrical connector in FIG. 7.
Figure 9:
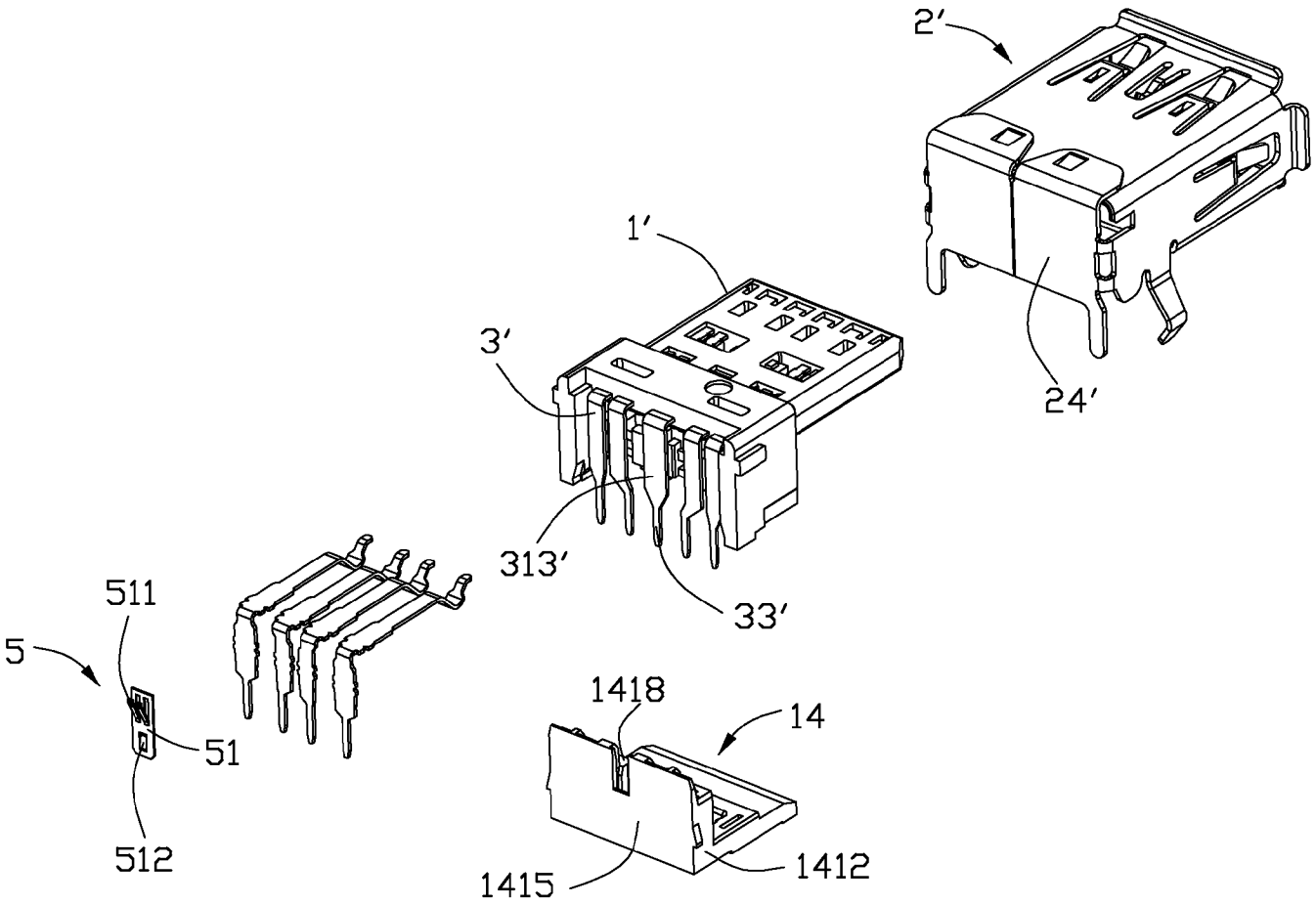
FIG. 9 is a similar view to FIG. 8, but taken from another aspect.
Figure 10:
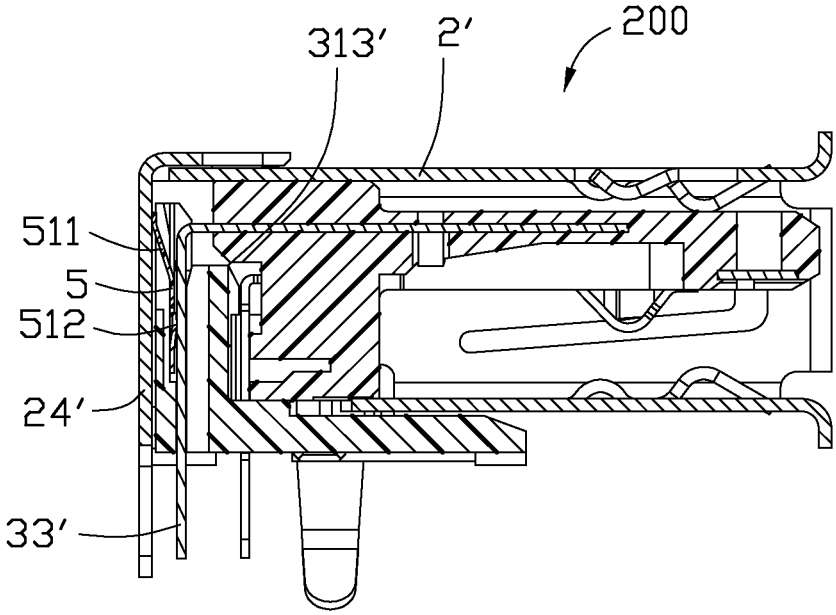
FIG. 10 is a cross-sectional view of the electrical connector taken along line 10-10 of FIG. 7.

Please reference to FIGS. 5-6, the insulative housing 1 includes a base portion 11, a tongue portion 12 extending forwardly from the base portion 11 and a spacer 13 retained in a rear of the base portion 11. The base portion 11 includes a top portion 111, a bottom portion 112 opposite to the top portion 111 and two side portions 113 connecting with the top portion 111 and the bottom portion 112. The base portion 11 defines a recess 1111 recessed from a middle of the top portion 111 and two slots 1112 recessed from two sidewalls of the recesses 1111 along a transverse direction of the recess 1111. The base portion 11 also defines two raises 1121 extending downwardly from the bottom portion 112. The two side portions 113 have a plurality of ribs 1131 protruding outwardly. The tongue portion 12 includes a top surface 121, a bottom surface 122 opposite to the top surface 121, and the bottom surface 122 defines four receiving passageways 1222 in a row and five retaining passageways 1221 in another row and in front of the receiving passageways 1222.

The spacer 13 comprises a body portion 131 and a supporting portion 132 extending forwardly from a bottom of the body portion 131. The body portion 131 includes a front end face 1311, two side end faces 1312, a top end face 1313 and a bottom end face 1314 opposite to the top end face 1313. The body portion 131 further has a plurality of first contact receiving slots 13131 passing therethrough along an upper to bottom direction. The middle one of the first contact receiving slots 13131 is wider than the other first contact receiving slots 13131. The body portion 131 has a plurality of retaining blocks 13111 extending downwardly from the top end face 1313 of the body portion 131 to the upper supporting portion 132. The supporting portion 132 defines a pair of through holes 1321 used for receiving the raises 1121 of the base portion 11 so that the support portion 132 can be firmly assembled to the base portion 11. The supporting portion 132 also has a plurality of second contact receiving slots 1322 behind the through holes 1321 and in front of the retaining blocks 13111.

Please referring to FIGS. 1, 5-6, the shell 2 is stamped from a metal piece and bent to surround the tongue portion 12 to form a receiving room 10. The shell 2 includes a top wall 21, a bottom wall 22 opposite to the top wall 21, two side walls 23 and a rear wall 24. The rear wall 24 is bent from the side walls 23. Each of the top wall 21, the bottom wall 22 and the side walls 23 has one or one pair elastic pieces 211, 221, 231 protruding into the receiving room 10, and the top wall 21 further has a resisting arm 212 between the pair of the elastic pieces 211 to strengthen an insertion force with the mating plug (not shown). The two side walls 23 have front retaining legs 232 extending downwardly beyond the bottom wall 22, and the rear wall 24 has back retaining legs 241 extending downwardly beyond the bottom wall 22 to be mounted on a printed circuit board (not shown). The two side walls 23 further have retaining slots 233 closed to the rear wall 24 and used to cooperate with the ribs 1131 of the base portion 11 so as to strengthen the housing 1 and the shell 2.

Figure 4:
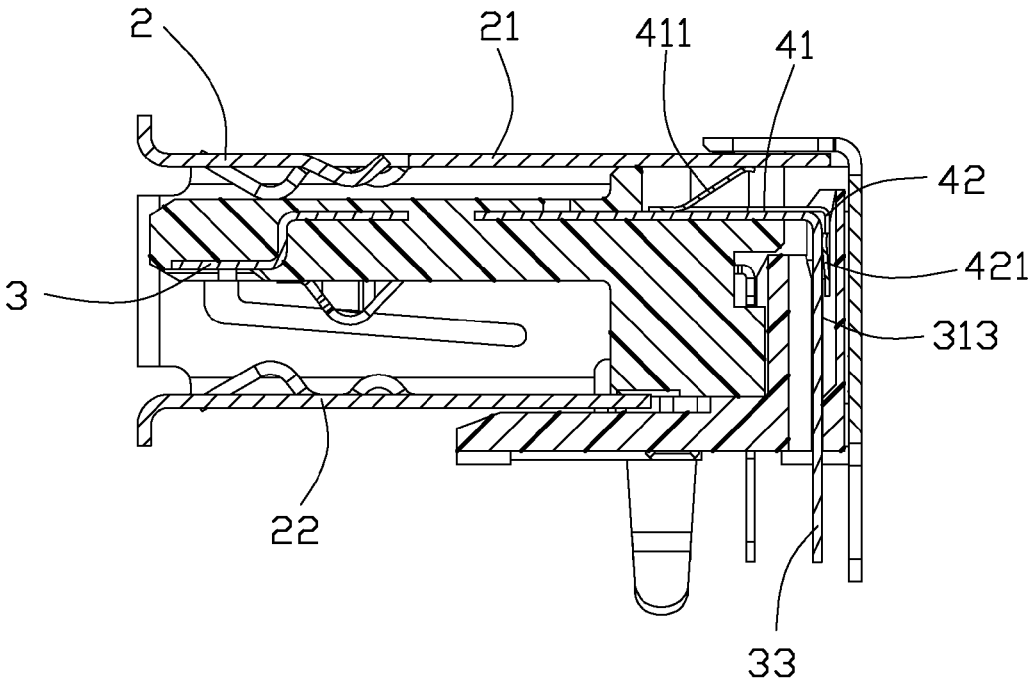
FIG. 4 is a cross-sectional view of the electrical connector taken along line 4-4 of FIG. 1.

Please referring to FIGS. 4-6, the contacts 3 comprises a plurality of first contacts 31 insert molded in the insulative housing 1 and a plurality of second contacts 32 assembled to the insulative housing 1 forwardly. Each of the first contacts 31 has a first retaining portion (not shown) retained to the tongue portion 12, a planar first contacting portion 312 extending forwardly from the first retaining portion (not shown) into the retaining passageways 1221, and a first connecting portion 313 extending from the first retaining portion (not shown) and downwardly received in the first contact receiving slot 13131 of the spacer 13 and a first soldering portion 314 extending beyond the spacer 13. The second contact 32 includes a retaining portion 321, a second contacting portion 322 extending forwardly from the second retaining portion 321, a second connecting portion 323 extending from the second retaining portion 321 and downwardly received in the second contact receiving slots 1322 and a second soldering portion 324 extending beyond the spacer 13.

The contacts 3 have five first contacts 31 including two pairs of differential signal contacts 34 and a grounding contact 33 between the two pairs. The first connecting portion 313 of the grounding contact 33 is wider than the first connecting portion 313 of the differential signal contacts 34. The first connecting portion 313 of one of the differential signal contacts 34 closed to the grounding contact 33 is offset along a direction far away from the grounding contact 33 relative to the corresponding first soldering portion 314 to increase a distance between the differential signal contacts 34 with the grounding contact 33 to reduce the signal cross talking between the contacts 3.

Please reference to FIGS. 2-5, the auxiliary contact 4 with roughly reverse L-shaped is stamped from a metal piece. The auxiliary contact 4 include a retaining portion 41 horizontally received in the recess 1111 of the base portion 11 and a connecting portion 42 extending downwardly from a rear edge of the retaining portion 41 and received in the spacer 13. The connecting portion 41 is located behind the first and second connecting portions 313,323 of the contacts 3, the retaining portion 41 is located at a top of the first and second retaining portion 311, 321. The connecting portion 42 of the auxiliary contact 4 and the first connecting portion 313 of the grounding contact 33 are received in a same first contact receiving slot 13131. The retaining portion 41 is torn to form a first shrapnel 411 elastically contacting against the top wall 21 of the shell 2. And the connecting portion 42 is torn to form a second shrapnel 421 elastically contacting against the first connecting portion 313 of the grounding contact 33. The retaining portion 41 further has two latches 412 protruding outwardly and being received in the slots 1112 so as to limit the auxiliary contact 4 to move back and forth. When the shell 2 is assembled to the insulative housing 1, the first shrapnel 411 elastically contacts against the top wall 21 of the shell 2 so that the shell 2 provides a reactive force to the retaining portion 41 so as to limit the retaining portion 41 and prevent the auxiliary contact 4 from falling off The auxiliary contact 4 electrically connects with the grounding contact 33 to the shell 2 which is reliably grounded, so that electromagnetic interference (EMI) of the electrical connector 100 can be reduced.

FIGS. 7-10 discloses another electrical connector 200 in alternative embodiment according to present invention. The electrical connector 200 has a plurality of contacts (not labeled), a shell (not labeled), a spacer 14, an insulative housing (not labeled) and an auxiliary contact 5. The electrical connector 200 is substantially same as the connector 100, but the auxiliary 5 is only attached to the spacer 14, so the insulative housing does not need to dispose recess or slot for receiving the auxiliary contact 5, and the spacer 14 is modified relative to the spacer 13 for the auxiliary contact 5, the detail description will be give in blow.

The spacer 14 has a body portion 141 and a supporting portion 142 extending forwardly from a bottom of the body portion 141. The body portion 141 includes a front end face 1411, two side end faces 1412, a top end face 1413, and a rear end face 1415 opposite to the front end face 1411. The spacer 14 further has a plurality of first contact retaining slots 14131 passing therethrough along an upper to bottom direction. The auxiliary contact 5 and a grounding contact 33' are both received in the middle one of the first contact receiving slots 14131. The spacer 14 is substantially same as the spacer 13 in the electrical connector 100, except that the rear end face 1415, different from the rear end face 1415, defines an opening 1418. The opening 1418 is throughout the body portion 141 and communicates with the middle one of the first contact receiving slots 14131. The auxiliary contact 5 is located between the grounding contact 33' and a rear wall 24' of shell 2.

The auxiliary contact 5 includes a flat portion 51 received in the middle one of the first contact receiving slots 14131, a first spring tab 511 extending upwardly and rearward from an upper part of the flat portion 51 and a second spring tab 512 extending upwardly and forwardly from a lower part of the flat portion 51. The first spring tab 511 and the second spring tab 512 are torn from the flat portion 51 and located respectively at a front and a rear of the flat portion 51. The auxiliary contact 5 is assembled to the spacer 14 along an upper to bottom direction, and the first spring tab 511 passes through the opening 1418 backwardly and elastically contacts against the rear wall 24' of the shell 2'. The second spring tab 512 elastically contacts against the first connecting 313' of the grounding contact 33'.

Referring to FIGS. 1-10, the auxiliary contact 4 of the electrical connector 100 at least has one first shrapnel 411 contacting against the shell 2 and one second shrapnel 421 contacting against the grounding contact 33 so as to increase the contact points with the grounding contact 33 and the grounding paths to avoid electromagnetic interference (EMI) and reduce the signal cross talking.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed. For example, the tongue portion is extended in its length or is arranged on a reverse side thereof opposite to the supporting side with other contacts but still holding the contacts with an arrangement indicated by the broad general meaning of the terms in which the appended claims are expressed.

We claim:

1. An electrical connector comprising:

an insulative housing;

a shell covering the insulative housing;

a plurality of contacts retained in the insulative housing, the contacts having a plurality of first contacts comprising contacts have two pairs of differential signal contacts and a grounding contact between the two pairs; and an auxiliary contact, the auxiliary contact retained to the insulative housing and electrically connecting with both the grounding contact and the shell; wherein auxiliary contact has a retaining portion received in the insulative housing and upwardly abutting against the shell and a connecting portion contact extending downwardly from the retaining portion and abutting against the grounding contact; wherein the retaining portion has two latches protruding outwardly, the insulative housing has a base portion, the base portion defines a recess recessed from a middle of the top portion there of and two slots recessed from the two sidewalls of the recess, the retaining portion of the auxiliary contact is received in the recess and the latches are received in the slots.

2. The electrical connector as claimed in claim 1, wherein the retaining portion has a first shrapnel contacting against the shell upwardly, and the connecting portion has a second shrapnel contacting against the grounding contact backwardly.

3. The electrical connector as claimed in claim 2, wherein the firs contact includes a first retaining portion received in the insulative housing, a first connecting portion extending downwardly from the rear end of the retaining portion and a soldering portion continue to extending downwardly from the connecting portion, the second shrapnel contacts against the first connecting of the grounding contact.

4. The electrical connector as claimed in claim 3, wherein the connecting portion of the auxiliary contact is located at a rear of the first connecting of the grounding contact, and the retaining portion is located on top of the first retaining portion of the grounding first contact.

5. The electrical connector as claimed in claim 3, wherein the insulative housing has a spacer with a body portion, the spacer further defines a plurality of first contact receiving slots passing there through along an upper to bottom direction and being used to receive the first connecting portions of the first contacts, the middle one of the first contact receiving slots is wider than the other first contact receiving slots, the auxiliary contact is received in the middle first contact receiving slot.

6. The electrical connector as claimed in claim 3, wherein the first connecting portion of the grounding contact is wider than the first connection portion of the differential signal contacts, and the first connecting portion of the differential signal contacts closed to the grounding contact offsets to be away from the grounding contact.

7. An electrical connector comprising:

an insulative housing;

a shell covering the insulative housing;

a plurality of contacts retained in the insulative housing, the contacts having a plurality of first contacts comprising two pairs of differential signal contacts and a grounding contact between the two pairs;

a spacer assembled and retained to the insulative housing, the spacer having a plurality of first contact receiving slots to receive the first contacts; and an auxiliary contact, the auxiliary contact retained to one of the first contact receiving slots which receives the grounding contact, to electrically contact with the grounding contact, and the auxiliary contact further extending rearward to electrically contact with the shell.

8. The electrical connector as claimed in claim 7, wherein the auxiliary contact has a flat portion, a first spring tab at an upper portion of the flat portion and a second spring tab at a lower portion of the flat portion, the first spring tab contacts against the shell and the second spring tab contacts against the grounding contact.

9. The electrical connector as claimed in claim 8, wherein the first spring tab extends upwardly from the flat portion and the second spring tab extends downwardly from the flat portion, the first spring tab and the second spring tab are located respectively at two opposite sides of the flat portion.

10. The electrical connector as claimed in claim 9, wherein the auxiliary contact is assembled to the insulative housing along an upper to bottom direction.

11. An electrical connector comprising:

an insulative housing assembly;

a plurality of contacts disposed in the housing assembly and including signal contacts and at least one grounding contact, each of said contacts including a front contacting section for mating and a rear mounting section for mounting;

a metallic shell enclosing the housing;

a discrete auxiliary contact retained in the housing assembly and including a first contacting piece resiliently extending toward and electrically and mechanically connected to the shell, and a second contacting piece mechanically and electrically connected to said grounding contact to establish a grounding path between the grounding contact and the shell; wherein the auxiliary contact contacts the shell in a first direction while contacting the grounding contact in a second direction different from said first direction; wherein the first direction is perpendicular to said second direction; wherein said auxiliary contacts defines an L-shaped main body including two parts perpendicular to each other, on which the first contacting piece and the second contacting piece are formed, respectively.

12. The electrical connector as claimed in claim 11, wherein said housing assembly includes an insulative housing where the contacting sections of the contacts are located and an insulative spacer where the mounting sections of the contacts are located, and the auxiliary contact is retained to one of said housing and said spacer.

13. The electrical connector as claimed in claimed 12, wherein the shell includes at least a top wall and a pair of side walls, and the auxiliary contact is located in the housing and mechanically and electrically connected to the top wall.

14. The electrical connector as claimed in claim 12, wherein the shell includes at least a rear wall and a pair of side walls, and the auxiliary contact is located in the spacer and mechanically and electrically connected to the rear wall.

15. The electrical connector as claimed in claim 11, wherein a retaining portion of the auxiliary contact is positioned closer to the grounding contact than to the shell.

16. The electrical connector as claimed in claim 11, wherein the second contacting piece are located in an insulative spacer attached to a rear side of the housing.

* * * * *